US011548060B2

(12) United States Patent
Gerard et al.

(10) Patent No.: US 11,548,060 B2
(45) Date of Patent: Jan. 10, 2023

(54) HIGH HEAT-ABSORPTION CORE FOR MANUFACTURING OF CASTINGS

(71) Applicant: GM GLOBAL TECHNOLOGY OPERATIONS LLC, Detroit, MI (US)

(72) Inventors: Dale A. Gerard, Bloomfield Hills, MI (US); Qigui Wang, Rochester Hills, MI (US); Tyson W. Brown, Royal Oak, MI (US); Ali Shabbir, Windsor (CA); Anil K. Sachdev, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 337 days.

(21) Appl. No.: 17/024,919

(22) Filed: Sep. 18, 2020

(65) Prior Publication Data

US 2022/0088671 A1 Mar. 24, 2022

(51) Int. Cl.

| | |
|---|---|
| ***B22C 9/10*** | (2006.01) |
| ***B22C 9/02*** | (2006.01) |
| ***B22D 17/22*** | (2006.01) |
| ***B22C 1/18*** | (2006.01) |

(52) U.S. Cl.

CPC ..... *B22C 9/10* (2013.01); *B22C 1/18* (2013.01); *B22C 9/02* (2013.01); *B22D 17/22* (2013.01)

(58) Field of Classification Search

CPC ..... B22C 9/10; B22C 9/02

See application file for complete search history.

(56) References Cited

U.S. PATENT DOCUMENTS

| | | | | |
|---|---|---|---|---|
| 10,525,525 | B2 * | 1/2020 | Propheter-Hinckley | B22C 9/22 |
| 2013/0220570 | A1 * | 8/2013 | Sears | B22F 10/14 164/34 |

FOREIGN PATENT DOCUMENTS

| | | | |
|---|---|---|---|
| DE | 19534836 | C2 | 3/1997 |
| DE | 60311824 | T2 | 10/2007 |
| WO | 0226419 | A1 | 4/2002 |

* cited by examiner

*Primary Examiner* — Kevin E Yoon

(74) *Attorney, Agent, or Firm* — Quinn IP Law

(57) ABSTRACT

A high heat-absorption casting core for manufacturing a cast component includes a core body. The core body has at least a portion thereof defined by metal powder. The metal powder is configured to absorb heat energy from the cast component during cooling of the component and solidification thereof. The core body may be additionally defined by a sand fraction in contact with the metal powder fraction. A system and a method for manufacturing a cast component using the high heat-absorption casting core are also envisioned.

16 Claims, 4 Drawing Sheets

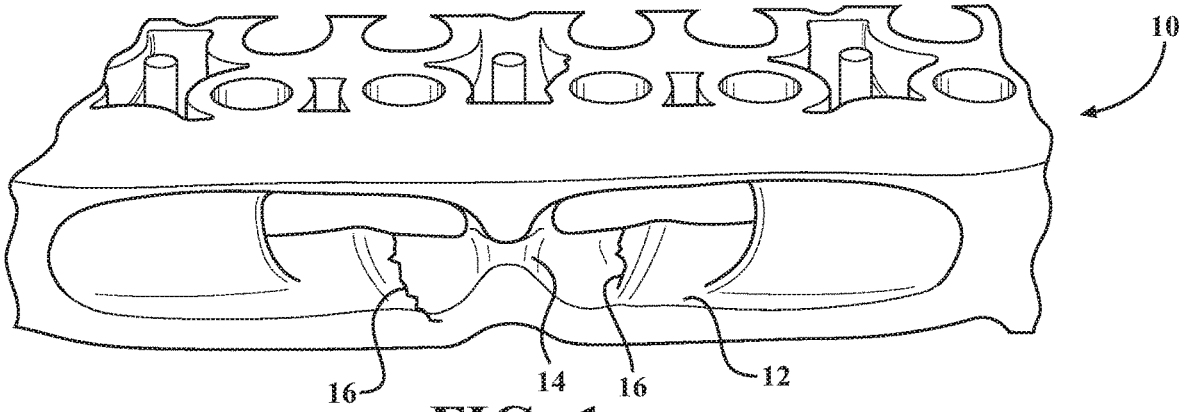
FIG. 1
FIG. 2
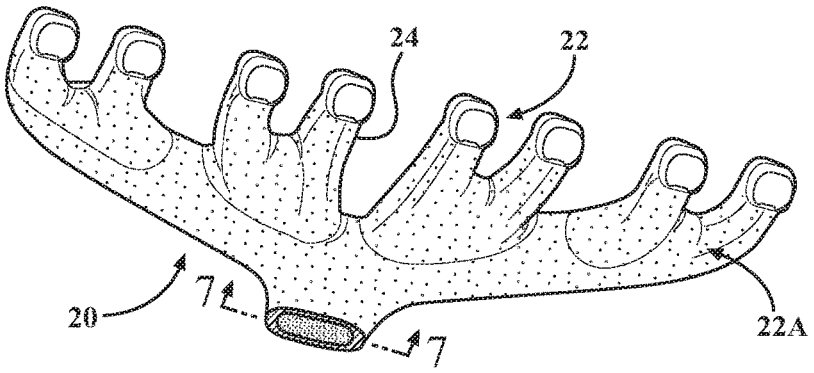
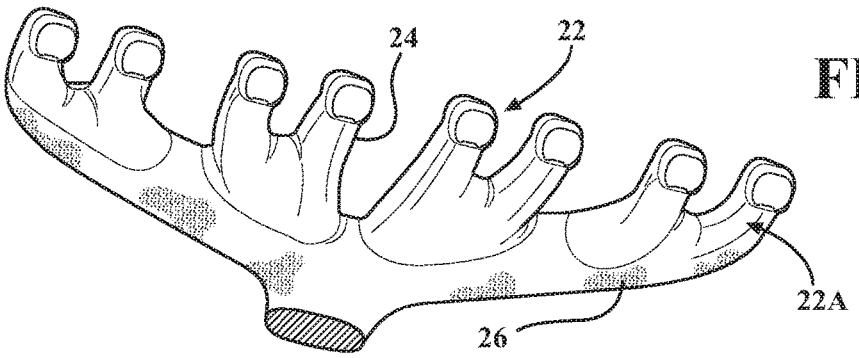
FIG. 3

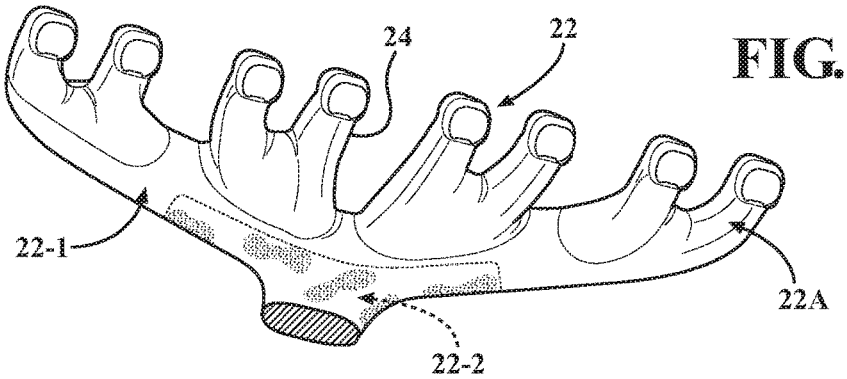
FIG. 4
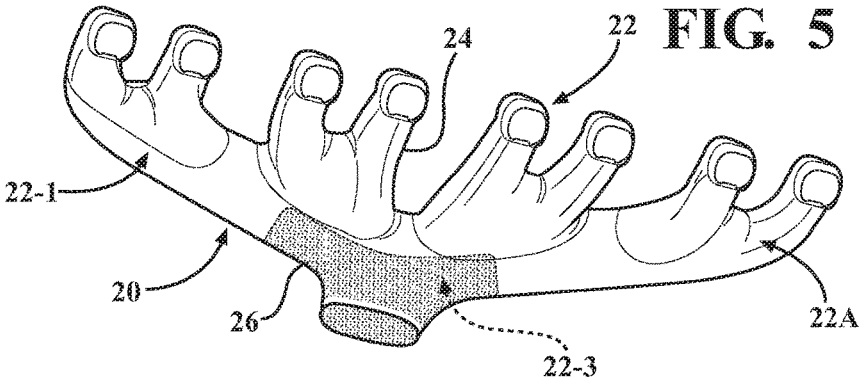
FIG. 5
FIG. 6
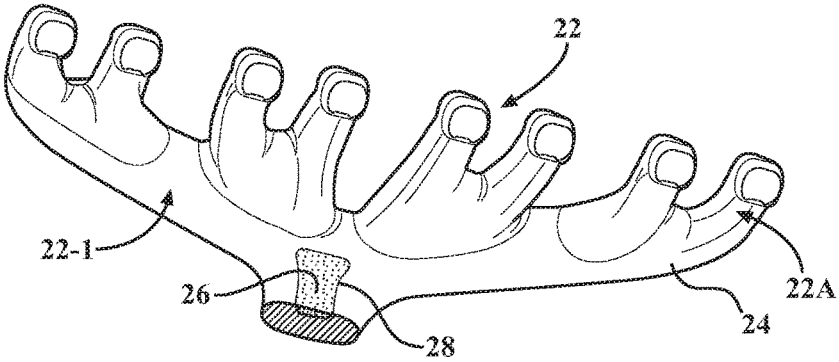
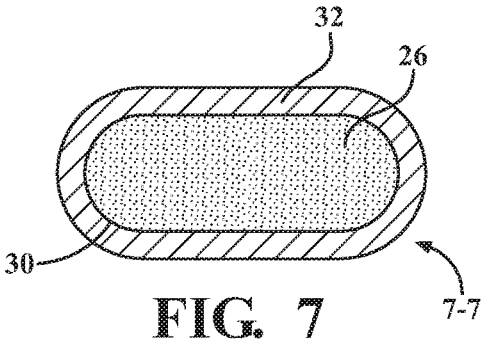
FIG. 7

HIGH HEAT-ABSORPTION CORE FOR MANUFACTURING OF CASTINGS

INTRODUCTION

The present disclosure relates to a high heat-absorption core for manufacturing of cast components.

Casting is a manufacturing process in which a liquid material is usually poured into a mold, which contains a hollow cavity of the desired shape, and then allowed to solidify. The solidified part is also known as a casting, which is ejected or broken out of the mold to complete the process. Casting is most often used for making complex shapes that would be otherwise difficult or uneconomical to make by other methods. Sand casting, also known as sand mold casting, is a metal casting process characterized by using sand as the mold material. The term "sand casting" may also refer to an object produced via the sand-casting process.

Certain bulky equipment like machine tool beds, ship propellers, combustion engine components (such as cylinder heads, engine blocks, and exhaust manifolds), etc., may be cast more easily in the required size, rather than be fabricated by joining several small pieces. The mold cavity and gating system are typically created by compacting the sand around models called patterns, by carving directly into the sand, or by 3D printing. The mold includes runners and risers that enable the molten metal to fill the mold cavity by acting as reservoirs to feed the shrinkage of the casting as it solidifies. During the casting process, metal is first heated until it becomes liquid and is then poured into the mold after certain melt treatment such as degassing, adding grain refiner, and adjusting alloy element contents. The mold gradually heats up after absorbing the heat from liquid metal. Consequently, the molten metal is continuously cooled until it solidifies. After the solidified part (the casting) is taken out of the mold and following a shake out, excess material in the casting (such as the runners and risers) is removed.

Cores are frequently used for sand casting components with internal cavities and reentrant angles, i.e., interior angles greater than 180 degrees. For example, cores are used to define multiple passages in engine blocks, cylinder heads, and exhaust manifolds. Cores are typically disposable items constructed from materials such as sand, clay, coal, and resin. Core materials generally have sufficient strength for handling in the green state, and, especially in compression, to withstand the forces, e.g., material weight, of casting, sufficient permeability to allow escape of gases, good refractoriness to withstand casting temperatures. Because cores are normally destroyed during removal from the solidified casting, core materials are generally selected to permit core break-up during shake out. The core material is typically recycled.

SUMMARY

A high heat-absorption casting core for manufacturing a cast component includes a core body. The core body has at least a portion thereof defined by metal powder. The metal powder is configured to absorb heat energy from the cast component during cooling of the component and solidification thereof.

The core body may be additionally defined by a sand fraction in contact with the metal powder fraction.

The core body may include a sand body segment and a mixed-material body segment. In such an embodiment, the mixed-material body segment may include the metal powder fraction intermixed with the core sand fraction.

The metal powder fraction may be magnetized to thereby maintain structural and dimensional integrity of the metal powder fraction.

The sand fraction may define a channel configured to retain the metal powder fraction.

The channel may retain the metal powder fraction intermixed with the core sand fraction.

The metal powder fraction may include particles of at least one of aluminum, copper, bronze, iron, and steel.

The core body may be defined by an exterior surface. Furthermore, the core body may include a coating on the exterior surface positioned to contact the cast component and configured to minimize sticking of the core body to the interior feature of the cast component.

The coating may include one of ceramic, nitride, silicon, and titanium.

The coating may have a thickness in a range of 50 nanometers to 5 microns.

A system and a method for manufacturing a cast component using such a high heat-absorption casting core are also disclosed.

The above features and advantages, and other features and advantages of the present disclosure, will be readily apparent from the following detailed description of the embodiment(s) and best mode(s) for carrying out the described disclosure when taken in connection with the accompanying drawings and appended claims.

BRIEF DESCRIPTION OF THE DRAWINGS

FIG. 1 is a schematic partial view of an embodiment of a cast component having an interior feature generally formed with the aid of a casting core, according to the disclosure.

FIG. 2 is a schematic top perspective view of an embodiment of a high heat-absorption casting core defined by a metal powder used to manufacture the interior feature of the cast component shown in FIG. 1, according to the disclosure.

FIG. 3 is a schematic top perspective view of another embodiment of the high heat-absorption casting core used to manufacture the interior feature of the cast component shown in FIG. 1, the particular core embodiment being defined by a combination of a sand fraction and a metal powder fraction, according to the disclosure.

FIG. 4 is a schematic top perspective view of another embodiment of the high heat-absorption casting core used to manufacture the interior feature of the cast component shown in FIG. 1, the particular core embodiment having a sand body segment and a separate mixed-material body segment having both the sand fraction and the metal powder fraction, according to the disclosure.

FIG. 5 is a schematic top perspective view of another embodiment of the high heat-absorption casting core used to manufacture the interior feature of the cast component shown in FIG. 1, the particular core embodiment having a sand body segment and a separate metal powder segment, according to the disclosure.

FIG. 6 is a schematic top perspective partial cutaway view of another embodiment of the high heat-absorption casting core used to manufacture the interior feature of the cast component shown in FIG. 1, the particular core embodiment having a sand fraction defining a channel for retaining the metal powder fraction, according to the disclosure.

FIG. 7 is a schematic cross-sectional front view of an embodiment of the high heat-absorption casting core having a coating, according to the disclosure.

DETAILED DESCRIPTION

Figure 8:
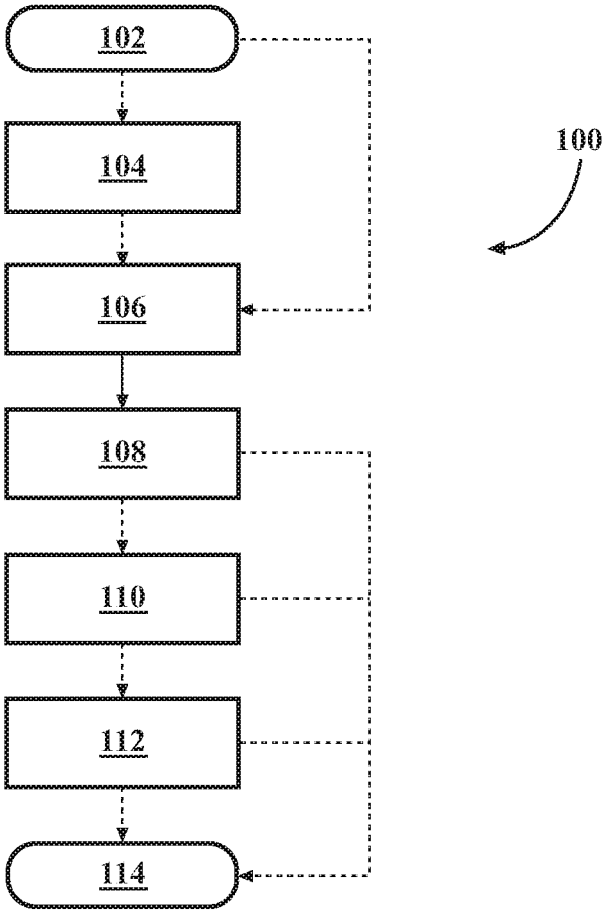
FIG. 8 is a flow diagram of a method of preparing the high heat-absorption casting core, shown in FIGS. 2-7, for generation of the cast component, according to the disclosure.

Terms such as "above", "below", "upward", "downward", "top", "bottom", etc., are used in the present disclosure descriptively for the figures, and do not represent limitations on the scope of the disclosure, as defined by the appended claims.

Referring to FIG. 1, a cast component 10 is depicted. The cast component 10 is specifically a "sand casting", also known as sand mold casting. Generally, a sand casting is a metal casting produced by using sand as the mold material. The cast component 10 may be a cylinder head (shown in FIG. 1) having an integrated exhaust manifold, such as for an internal combustion gasoline engine or a diesel engine (not shown). A separate embodiment of the cast component 10 may be configured as another part for a piece of machinery, industrial equipment, etc.

As shown in each of FIG. 1, the cast component 10 includes an interior feature 12, such as internal cavity, a reentrant angle (an interior angle greater than 180 degrees), or a passage formed by using a core during the casting process. In the particular cylinder head embodiment of the cast component 10, the interior feature 12 is specifically depicted as exhaust passages or runners of the integrated exhaust manifold converging into an exhaust collector. Generally, a core is a disposable item constructed from materials specifically selected to permit the subject core be removed from the cast component 10 after its solidification in the mold. During the casting process, the molten metal generally solidifies at a rate that depends on the design of the mold and the thermal conductivity of the core.

In general, the faster the solidification rate, the finer the cast material microstructure and thus the higher the mechanical properties of the casting. Typically, a sand core has low thermal conductivity and affects coarse material microstructure and low material properties in the finished casting. For example, low cooling rate during solidification of the cast component 10 around an exhaust manifold wall 14 with the use of a sand core may result in a crack 16 (shown in FIG. 1) when the cast component like the cylinder head is subject to engine durability testing or road use, as the particular area experiences high thermal and mechanical stresses. As described in detail below, a high heat-absorption casting core of various configurations is envisioned to increase local solidification rate of the liquid metal and enhance local material properties of the cast component 10.

Sand cores are typically produced by introducing core sand into specifically configured core boxes, for example half core, dump core, split core, and gang core boxes. Specific binders may be added to core sands to enhance the core strength. Dry-sand cores are frequently produced in dump core boxes, in which sand is packed into the box and scraped level with the top of the box. A plate, typically constructed from wood or metal, is placed over the box, and then the box with the plate in place is flipped over such that the formed core segment may drop out of the core box. The formed core segment is then baked or otherwise hardened. For complex shape cores, multiple core segments may be hot glued together or joined using other attachment methods.

Simple shape one-piece sand cores may also be produced in split core boxes. A typical split core box is made of two halves and has at least one hole for introduction of sand for the core. Cores with constant cross-sections may be created using specifically configured core-producing extruders. The resultant extrusions are then cut to proper length and hardened. Single-piece cores with more complex shapes may be made in a manner similar to injection moldings and die castings. Following extraction and, if required, assembly of the core segments, rough spots on the surface of the resultant core may be filed or sanded down. Finally, the core is lightly coated with graphite, silica, or mica to give the core a smoother surface finish and greater resistance to heat.

A high heat-absorption casting core 20, shown in various configurations in FIGS. 2-5, is configured to address the thermal stress related cracking 16 of the cast component 10, such as in the proximity to the wall 14. The casting core 20 is particularly configured for manufacturing the cast component 10, and more particularly for forming the interior feature 12. The high heat-absorption casting core 20 has a core body 22 defined by an exterior shape 22A and is configured to define the interior feature 12 of the cast component 10. The core body 22 includes at least a portion thereof defined by a metal powder. Specifically, in one embodiment, as shown in FIG. 2, the core body 22 may be defined by and completely formed from the metal powder. Wherein the entirety of the core body 22 is configured to absorb heat energy from the cast component 10 during cooling and solidification thereof.

In another embodiment, as shown in FIG. 3, the core body 22 may include a sand fraction 24 and a metal powder fraction 26. In such a combined structure of the core body 22, the sand fraction 24 is in contact with the metal powder fraction 26, and the two fractions together define the exterior shape 22A. In the particular embodiment of FIG. 3, the metal powder fraction 26 is dispersed through the sand fraction 24, and is specifically configured to absorb heat energy from the molten metal during formation and solidification of the cast component 10. Each of the sand fraction 24 and the metal powder fraction 26 may form as large or small a portion of the core body 22, with particular arrangement relative to each other, as necessitated by the structural requirements of the cast component 10, i.e., mechanical properties thereof. An optimized combination of the core sand fraction 24 and the metal powder fraction 26 in the core body 22, as well as the appropriate geometry of the subject fractions, may be optimized based on experimental data acquired during casting of the component 10 using computer aided engineering (CAE).

The core body 22 may be defined by the metal powder fraction 26 intermixed with the sand fraction 24 in specific proportion to control the cooling rate of the molten metal during its solidification. The core body 22 may be formed in a core box with the sand fraction 24 and the metal powder fraction 26 premixed in the requisite proportion, which may vary locally across the core body. As shown in FIG. 4, the core body 22 may include a sand body segment 22-1 defined by a body of green sand but no metal powder fraction mixed therewith, and a separate mixed-material body segment 22-2. According to the present disclosure, the mixed-material body segment 22-2 may specifically include the metal powder fraction 26 intermixed with the core sand fraction 24.

In a separate embodiment, as shown in FIG. 5, the metal powder fraction 26 may be locally concentrated within a metal powder body segment 22-3. Especially, but not exclusively, wherein the metal powder fraction 26 is concentrated locally, such as shown in FIG. 5, the metal powder fraction may be magnetized to thereby maintain structural and dimensional integrity of the metal powder fraction. Alternatively, the locally concentrated metal powder fraction 26 may be mixed with a binder to maintain its structural and dimensional integrity among the sand fraction 24. The binder, such as a phenolic urethane resin, a catalyst like amine gas, is introduced into the core box and purged through the core with superheated air. Such a binder may be generally sufficiently strong to keep the metal powder together for casting the component 10, while also permitting the core body 22, including the metal powder fraction 26, to be fractured and removed during shakeout.

In general, the metal powder material should have higher melting temperature than the material used for the actual casting. For cast components manufactured from aluminum, for instance, material for the metal powder fraction 26 may be selected from copper, bronze, cast iron, tool (stainless) steel, a Ni based alloy, or galvanized steel. Such metal chill element materials may be employed primarily because thermal conductivity (and durability) of copper, bronze, cast iron, or tool steel is higher than that of aluminum. Such metal powder materials may be employed primarily because of their high thermal conductivity and durability. However, for aluminum castings, when used with a ceramic coating, aluminum powder (whose melting point is around 660 degrees C.) may also be used as the material for the metal powder fraction.

Another option for the coating metal powder fraction core is spray-on alcohol-based graphite coating. Such a spray-on coating may include graphite flakes/particles (60~70%), organic bentonite (2-3%), organic binder (1-2%), inorganic binder (1.5-2.5%), polyvinyl butyral (PVB, 0.2-0.5%), additives (2-5%), and remaining mixture based on anhydrous ethanol with other alcohol solvent(s). The material of the metal powder may be copper, bronze, cast iron, tool (stainless) steel, galvanized steel, or Ni based alloys to minimize the likelihood of the powder sintering when exposed to molten metal during the casting process and thereby facilitate ease of the casting core 20 shake out. Additionally, a non-oxidizing material (such as various oxides, nitrides, carbides), and borides (such as polycrystalline diamond ceramics, aluminum nitride, beryllium oxide, silicon nitride, and silicon carbide), may be specified for the sand fraction 24 to minimize reduction of heat transfer from the molten metal to the casting core 20.

As shown in FIG. 6, the core body 22 may define a channel 28 configured to hold or retain the metal powder fraction 26, either mixed with sand or as a substantially homogenous body of metal powder. Alternatively, the channel 28 may hold the metal powder fraction 26 intermixed with the core sand fraction 24. For example, the channel 28 may be specifically defined by the sand of the sand body segment 22-1. The channel 28 may be defined internally within the sand fraction 24 to retain the metal powder fraction 26 therein. The core body 22 having such an internal channel 28 may be generated via a 3D printing process together with the metal powder fraction 26 printed therein.

The core body 22 shown in FIG. 2 may be defined by an exterior surface 30, (as shown in a cross-sectional view 7-7 in FIG. 7). The exterior surface 30 of the core body 22, including exposed surfaces of the metal powder fraction 26, may come in direct contact with the molten material during mold filling and solidification of the cast component 10. To address such an eventuality, the core body 22 may include a coating 32 (shown in FIG. 7) applied to the exterior surface 30 thereof. The coating 32 is specifically intended to minimize possible sticking of the metal powder fraction 26 to the cast component 10 in areas of direct contact between the metal powder fraction and the interior feature 12.

The coating 32 would be additionally selected to have the least effect on, i.e., not restrict, transfer of heat energy from the cast component 10 to the metal powder fraction 26. The coating 32 may be applied as a sprayable mold wash. Specific compositions of the mold washes may be: ~30% water, ~10% soluble mineral oil, ~10% Kerosene, ~40% silica flour, and ~10% ceramic powders. To limit the effect of the coating 32 on heat transfer, the composition of the coating may include ceramic, nitride, silicon, or titanium, for example, according to a non-limiting list, ceramic-aluminide, nitride-aluminide, and titanium-aluminide, silicon-nitride, silicon-carbide, a diamond-like coating, boron nitride, and cerium oxide. To further limit its effect on heat transfer, the coating 32 may have a thickness in a range of 50 nanometers (nm) to 5 micrometers or microns (μm), depending on the sizes of silica flour and ceramic powders used in the wash.

By absorbing heat energy from the molten metal, the metal powder of the core body 22, such as in the metal powder fraction 26, is intended to yield refined microstructure of the casting material and improved mechanical properties of the cast component 10 under operation. Such improved mechanical properties will in turn minimize the likelihood of cracking of the cast component 10 during thermal and mechanical loading. For example, in manufacturing aluminum castings, the metal powder fraction 26 is intended to enhance localized cooling of the casting, and thereby decrease the cast aluminum material's dendrite arm spacing (DAS), which would improve the strength of the cast component 10 in the region around the interior feature 12.

The metal powder fraction 26 may be arranged strategically in locations where the cooling rate of the core sand would otherwise result in reduced rate of solidification of the molten metal, and reduced material properties and increased cracking of the cast component 10 during thermal and mechanical loading. Such particular locations in the cast component 10 may be identified by methods such as CAE. Such methods may use various analytical algorithms for analysis of the component structure under virtual testing parameters simulating, operating conditions for identification of high stress areas. Based on such an analysis, the core body 22 may be packed or printed via the 3D printing process using the metal powder fraction 26 intermixed with loose sand of the sand fraction 24 and binder.

Either by forming the entirety of the core body 22 or defining a particular part of the core body 22, the metal powder is configured to be easily removed during shake out of the casting core 20 from the cast component 10 subsequent to the solidification of the molten metal. Ease of break-up of the core body 22 made up entirely of the metal powder or of the core body defined by the metal powder fraction 26 together with the core sand fraction 24 is intended to facilitate efficient removal of the casting core 20 from the formed cast component 10 without damaging or otherwise disrupting the solidified structure of the cast component. The material of the high heat-absorption casting core 20 may then be recycled.

A method 100 of preparing the high heat-absorption casting core 20 for generation of the cast component 10 is shown in FIG. 8 and described below with reference to the structure of the hybrid core shown in FIGS. 2-7. Method 100 commences in frame 102 with generating an embodiment of the core body 22 having at least a portion thereof defined by metal powders. As described above, the high heat-absorption casting core 20 may include each of the sand fraction 24 and the metal powder fraction 26, which may be combined to form the core body 22 by one of the above-disclosed approaches. The metal powder, whether defining the entirety of the core body 22 or forming the metal powder fraction 26, may be mixed with a binder to maintain geometric integrity thereof. Alternatively, as described above, the metal powder may be magnetized to achieve the same purpose.

Specifically, in frame 102 the method may include introducing the core sand fraction 24 and the metal powder fraction 26 into the core box and compacting the materials of the two fractions until the core box is full, e.g., the sand and metal powders are level with the top of the core box. Alternatively, the method may include using the 3D printing process to generate the core body 22, as disclosed above with respect to FIGS. 2-7. Following frame 102, the method may advance to frame 104. In frame 104, the method includes applying the coating 32 to the exterior surface 30 of the high heat-absorption casting core 20, and specifically to the exposed portion(s) of the metal powder fraction 26. After frame 102 or frame 104 the method will move on to frame 106. In frame 106, the method includes arranging the formed high heat-absorption casting core 20 in a core box. From frame 106, the method moves on to frame 108. In frame 108 the method includes extracting the formed casting core 20 from the core box. After frame 108 the method may proceed to frame 110.

In frame 110 the method may include hardening the formed casting core 20, such as by baking in a furnace at temperatures in the range of 200 to 250 degrees C. Alternatively, if self-hardening bonded sand is used (where typically two or more binder components are mixed with sand) for the sand fraction 24, the sand will cure and self-harden at room temperature. Following frame 110, the method may advance to frame 112. In frame 112 the method includes smoothing out, e.g., filing or sanding down, the outer surface of the hybrid core. Additionally, in frame 112 the method may include coating the outer surface of the casting core 20 with a suitable compound, such as graphite, silica, or mica to give the hybrid core a smoother surface finish and greater resistance to heat. The method may conclude in frame 114 following one of the frames 108-112, with packaging or storing the high heat-absorption casting core 20 in preparation for placing thereof in a mold for subsequent generation of the cast component 10.

Figure 9:
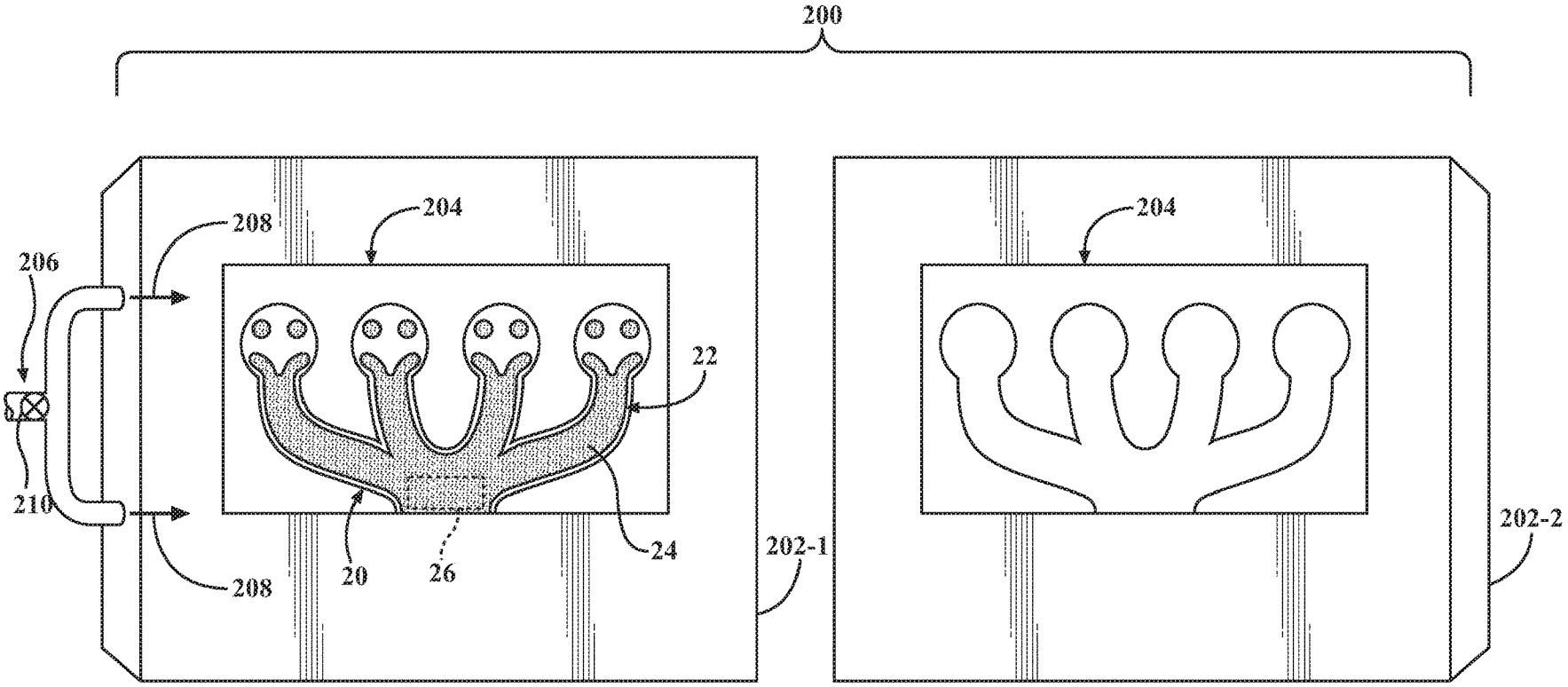
FIG. 9 is a schematic illustration of a system for manufacturing the cast component shown in FIG. 1, the system including the high heat-absorption casting core shown in FIGS. 2-7, according to the disclosure.

A system 200 for manufacturing the cast component 10 is shown in FIG. 9 and described with reference to method 100 shown in FIG. 8 and the structure of high heat-absorption casting core 20 shown in FIGS. 2-7. As shown for exemplary purposes, the cast component 10 may be an aluminum cylinder head defining a cast-in integrated exhaust manifold. The system 200 specifically includes a mold 202 having a first or top half 202-1 and a second or bottom half 202-2 and a gating system (not shown). The first half 202-1 and the second half 202-2 of the mold 202 together define an inner cavity 204. The inner cavity 204 is configured to form an exterior shape of the cast component 10. The inner cavity 204 and the gating system may be created by compacting green sand or chemically bonded sand around a pattern, by carving directly into the sand, or by 3D printing.

The system 200 also includes the high heat-absorption casting core 20 having a core body 22 with at least a portion thereof defined by metal powders, such as having the metal powder fraction 26, as described above with respect to FIGS. 2-7. The casting core 20 is arranged within the inner cavity 204 and configured to define the interior feature 12 of the cast component 10, such as exhaust gas passages of an integrated exhaust manifold. The system 200 further employs a mechanism 206 for introducing a molten metal 208, such as aluminum, into the cavity 204, to thereby form the cast component 10. The mechanism 206 may include a flow valve 210 and a system of runners and risers (not shown), with the valve operatively connected to the mold 202 for supplying the molten metal 208. Operation of the flow valve 210 may be regulated via an electronic controller (not shown). The electronic controller may be programmed to dispense a specific amount of molten metal 208 into the mold 202 at a predetermined material flow rate to ensure appropriate fill of the cavity 204. Alternatively, the mechanism 206 may employ a pouring basin with an arrangement of down sprue(s) and ingates (not shown) to gravity feed and fill the cavity 204.

When introduced via the mechanism 206, the molten metal 208 flows into the cavity 204 and around the high heat-absorption casting core 20 to form the exterior shape and the interior feature 12 of the cast component 10. The high heat-absorption casting core 20, and specifically the metal powder fraction 26, controls solidification of the molten metal 208 around the interior feature 12 to enhance mechanical properties of the manufactured cast component 10 in the region around the interior feature. The molten metal 208 is permitted to cool and solidify, after which the cast component 10 is removed from the mold 202. As described above, the casting core 20 is removed from the solidified cast component 10 during the core shakeout process, with the brake-up of the core sand fraction 24 and the metal powder fraction 26 facilitating extraction of the core body 22 from the finished casting.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

What is claimed is:

1. A high heat-absorption casting core for manufacturing a cast component, the core comprising:

a core body having at least a portion thereof defined by metal powder, wherein the metal powder is configured to absorb heat energy from the cast component during cooling of the component and solidification thereof, wherein the core body is additionally defined by a sand fraction in contact with the metal powder fraction, and the metal powder fraction is magnetized to thereby maintain structural and dimensional integrity of the metal powder fraction.

2. The casting core of claim 1, wherein the core body includes a sand body segment and a mixed-material body segment, and wherein the mixed-material body segment includes the metal powder fraction intermixed with the core sand fraction.

3. The casting core of claim 1, wherein the sand fraction defines a channel, and wherein the channel retains the metal powder fraction.

4. The casting core of claim 3, wherein the channel retains the metal powder fraction intermixed with the core sand fraction.

5. The casting core of claim 2, wherein the metal powder fraction includes particles of at least one of aluminum, copper, bronze, iron, and steel.

6. The casting core of claim 1, wherein the core body is defined by an exterior surface, and wherein the core body includes a coating on the exterior surface positioned to contact the cast component and configured to minimize sticking of the core body to the interior feature of the cast component.

7. The casting core of claim 6, wherein the coating includes one of ceramic, nitride, silicon, and titanium.

8. The casting core of claim 6, wherein the coating has a thickness in a range of 50 nanometers to 5 microns.

9. A system for manufacturing a cast component, the system comprising:

a mold having a first half and a second half defining an inner cavity configured to form an exterior shape of the cast component;

a high heat-absorption casting core arranged within the inner cavity of the mold and configured to define an interior feature of the cast component, the casting core including:

a core body having at least a portion thereof defined by metal powder;

wherein:

the metal powder is configured to absorb heat energy from the cast component during cooling of the component and solidification thereof, the core body is additionally defined by a sand fraction in contact with the metal powder fraction, and the metal powder fraction is magnetized to thereby maintain structural and dimensional integrity of the metal powder fraction; and the casting core is configured to be removed during shake out from the cast component subsequent to the solidification thereof; and a mechanism for introducing a molten material into the cavity to form the cast component such that the molten material flows into the cavity and around the hybrid core to form the exterior shape and the interior feature of the cast component.

10. The system of claim 9, wherein the core body includes a sand body segment and a mixed-material body segment, and wherein the mixed-material body segment includes the metal powder fraction intermixed with the core sand fraction.

11. The system of claim 9 wherein the sand fraction defines a channel, and wherein the channel retains the metal powder fraction.

12. The system of claim 11, wherein the channel retains the metal powder fraction intermixed with the core sand fraction.

13. The system of claim 9, wherein the metal powder fraction includes particles of at least one of aluminum, copper, bronze, iron, and steel.

14. The system of claim 9, wherein the core body is defined by an exterior surface, and wherein the core body includes a coating on the exterior surface positioned to contact the cast component and configured to minimize sticking of the core body to the interior feature of the cast component.

15. The system of claim 14, wherein the coating includes one of ceramic, nitride, silicon, and titanium.

16. The system of claim 14, wherein the coating has a thickness in a range of 50 nanometers to 5 microns.

* * * * *